US005372530A

United States Patent [19]

Holtermann et al.

[11] Patent Number: 5,372,530

[45] Date of Patent: Dec. 13, 1994

[54] OUTBOARD MOTOR WITH SEPARATED EXHAUST GAS PULSING AND EXHAUST GAS DISCHARGE

[76] Inventors: Theodore J. Holtermann, 4280 Imperial Dr., Brookfield, Wis. 53005; Lee A. Woodward, 2333 Arlington Ave., Racine, Wis. 53403

[21] Appl. No.: 127,793

[22] Filed: Sep. 28, 1993

Related U.S. Application Data

[63] Continuation-in-part of Ser. No. 822,972, Jan. 21, 1992, abandoned, which is a continuation of Ser. No. 20,905, Feb. 22, 1993, Pat. No. 5,306,185.

[51] Int. Cl.[5] ..... B63H 21/32

[52] U.S. Cl. ..... 440/89; 60/302; 60/314

[58] Field of Search ..... 440/89, 88; 60/299, 60/302, 312, 313, 314

[56] References Cited

U.S. PATENT DOCUMENTS

| | | | |
|---|---|---|---|
| 3,939,807 | 2/1976 | Eichinger | 123/41.08 |
| 4,312,422 | 1/1982 | Matsushita | 181/272 |
| 4,337,054 | 6/1982 | Holtermann et al. | 440/89 |
| 4,660,378 | 4/1987 | Scharpf | 60/313 |
| 4,735,046 | 4/1988 | Iwai | 60/295 |
| 4,772,236 | 9/1988 | Takahashi | 440/89 |
| 4,800,720 | 1/1989 | Okada | 60/313 |
| 4,843,815 | 7/1989 | Smojver | 60/299 |
| 4,848,082 | 7/1989 | Takahashi et al. | 60/285 |
| 4,900,282 | 2/1990 | Takahashi et al. | 440/89 |
| 4,924,820 | 5/1990 | Lear et al. | 60/302 X |
| 4,940,435 | 7/1990 | Osborn et al. | 440/89 |
| 4,966,567 | 10/1990 | Breckenfeld et al. | 440/89 |
| 5,100,351 | 3/1992 | Shibata | 440/89 |
| 5,174,112 | 12/1992 | Sougawa et al. | 60/302 |
| 5,203,167 | 4/1993 | Lassanke et al. | 440/89 X |
| 5,212,949 | 5/1993 | Shiozawa | 60/298 |

FOREIGN PATENT DOCUMENTS

| | | |
|---|---|---|
| 3736500A1 | 5/1989 | Germany . |
| 57-150099 | 9/1982 | Japan . |
| 59-168698 | 5/1984 | Japan . |
| 63-36014 | 2/1988 | Japan . |

*Primary Examiner*—Sherman Basinger

[57] ABSTRACT

Disclosed herein is an outboard motor comprising an engine block assembly including a lower surface having therein first and second exhaust gas openings, upper and lower cylinders having respective axes parallel to the lower surface and including respective exhaust ports, an exhaust gas collector passage communicating with the exhaust ports, an exhaust gas pulse passage extending between the collector passage and the first exhaust gas opening, and an exhaust gas discharge passage extending between the collector passage and the second exhaust gas opening and including therein a catalytic element, a drive shaft housing fixed to the lower surface of the engine block and including a discharge gas duct terminating in an underwater discharge opening, and an exhaust gas housing located in the drive shaft housing and including an upper end fixed to the lower surface of the engine block, a lower end, an exhaust gas pulse passageway communicating, at the upper end thereof, with the first exhaust gas opening and being closed except for communication with the first exhaust gas opening, and an exhaust gas discharge passageway communicating, at the upper end thereof, with the second exhaust gas opening, communicating, at the lower end thereof, with the discharge duct in the drive shaft housing, and being independent of the exhaust gas pulse passageway within the exhaust gas housing.

23 Claims, 4 Drawing Sheets

OUTBOARD MOTOR WITH SEPARATED EXHAUST GAS PULSING AND EXHAUST GAS DISCHARGE

RELATED APPLICATION

This application is a continuation-in-part application including the subject matter of previous application Ser. No. 822,972 filed Jan. 21, 1992, now abandoned, which application was continuned as application Ser. No. 020,905 filed on Feb. 22, 1993 now U.S. Pat. No. 5,306,185.

BACKGROUND OF THE INVENTION

The invention relates generally to marine propulsion device such as outboard motors including two-stroke internal combustion engines. The invention also relates to so called "tuning" of such engines, i.e., to timing of the arrival of returning acoustical pressure waves at the cylinder exhaust ports. In addition, the invention relates to catalytic treatment of the exhaust gases of such engines to reduce emission of pollutants.

Attention is directed to the following U.S. Pat. Nos:

| | | |
|---|---|---|
| 3,939,807 | Eichinger | February 24, 1976 |
| 4,312,422 | Matsushita, et al. | January 26, 1982 |
| 4,337,054 | Holtermann, et al. | June 29, 1982 |
| 4,660,738 | Scharpf | April 28, 1987 |
| 4,735,046 | Iwai | April 5, 1988 |
| 4,772,236 | Takahashi | September 20, 1988 |
| 4,800,720 | Okada | January 31, 1989 |
| 4,848,082 | Takahashi, et al. | July 18, 1989 |
| 4,900,282 | Takahashi, et al. | February 13, 1990 |
| 4,940,435 | Osborn, et al. | July 10, 1990 |
| 4,966,567 | Breckenfeld, et al. | October 30, 1990 |
| 5,100,351 | Shibata | March 31, 1992 |
| 5,174,112 | Sougawa, et al. | December 29, 1992 |
| 5,212,949 | Shiozawa | May 25, 1993 |
| FOREIGN PATENTS | | |
| Japanese Patent Public Disclosure No. 36014/88 | | February 16, 1988 |
| German Patent DE 3736500 A1 | | November 5, 1989 |
| Japanese Patent Public Disclosure No. 150099/82 | | September 20, 1982 |
| Japanese Utility Model Publication 59-73534 | | |

SUMMARY OF THE INVENTION

The invention provides an outboard motor comprising an engine block including a lower surface having therein first and second exhaust gas openings, a drive shaft housing fixed to the lower surface of the engine block and including a discharge duct terminating in an underwater discharge opening, and an exhaust gas housing located in the drive shaft housing and including an upper end fixed to the lower surface of the engine block, a lower end, an exhaust gas pulse passageway communicating, at the upper end, with the first exhaust gas opening and being closed except for communication with the first exhaust gas opening, and an exhaust gas discharge passageway communicating, at the upper end, with the second exhaust gas opening, communicating, at the lower end, with the discharge duct in the drive shaft housing, and being independent of the exhaust gas pulse passageway within the exhaust gas housing.

The invention also provides an outboard motor as indicated above wherein the engine block also includes upper and lower cylinders having respective axes parallel to the lower surface and including respective exhaust ports, an exhaust gas collector passage communicating with the exhaust ports, an exhaust gas pulse passage communicating between the collector passage and the first exhaust gas opening, and an exhaust gas discharge passage communicating between the collector passage and the second exhaust gas opening and including a portion containing a catalytic coverter.

The invention also provides an engine block assembly including a flat surface having therein first and second exhaust gas openings, a crankcase, first and second cylinders extending from the crankcase and respectively including first and second exhaust gas ports, and an exhaust gas passage system communicating with the exhaust gas ports and including an exhaust gas pulse passage terminating in the first exhaust gas opening, and an exhaust gas discharge passage terminating in the second exhaust gas opening and including a portion containing therein a catalytic element.

The invention also provides an outboard motor comprising an engine block assembly including a lower surface having therein first and second exhaust gas openings, a crankcase, upper and lower cylinders extending from the crankcase and respectively including first and second exhaust gas ports, and an exhaust gas passage system including a collector passage communicating with the exhaust gas ports, an exhaust gas pulse passage communicating between the collector passage and the first exhaust gas opening, and an exhaust gas discharge passage communicating between the collector passage and the second exhaust gas opening and including a portion containing a catalytic element, a drive shaft housing fixed to the lower surface of the engine block assembly and including a discharge duct terminating in an underwater discharge opening, and an exhaust gas housing located in the drive shaft housing and including an upper end fixed to the lower surface of the engine block assembly, a lower end, an exhaust gas pulse passageway communicating, at the upper end, with the first exhaust gas opening and being closed except for communication with the first exhaust gas opening, and an exhaust gas discharge passageway communicating, at the upper end, with the second exhaust gas opening, communicating, at the lower end, with the discharge duct in the drive shaft housing, and being independent of the exhaust gas pulse passageway within the exhaust gas housing.

The invention also provides an outboard motor comprising an engine block including a lower surface having therein an exhaust gas opening, a drive shaft housing fixed to the lower surface of the engine block and including a discharge duct terminating in an underwater discharge opening, and an exhaust gas housing located in the drive shaft housing and including an upper end fixed to the lower surface of the engine block, a lower end, an exhaust gas discharge passageway communicating, at the upper end, with the exhaust gas opening, communicating, at the lower end, with the discharge duct in the drive shaft housing, and including therein a catalytic element, and an exhaust gas pulse passageway communicating, at the upper end, with the exhaust gas opening, being closed except for communication with the exhaust gas opening and, at the upper end, with the exhaust gas discharge passage.

The invention also provides an outboard motor comprising an engine block including a lower surface having therein an exhaust gas opening, a crankcase, upper and lower cylinders extending from the crankcase and respectively including first and second exhaust gas ports, and an exhaust gas passage system including a collector passage communicating between the exhaust gas ports and the opening, and a drive shaft housing fixed to the lower surface of the engine block and including a discharge duct terminating in an underwater discharge opening, and an exhaust gas housing located in the drive shaft housing and including an upper end fixed to the lower surface of the engine block, a lower end, an exhaust gas pulse passageway communicating, at the upper end, with the exhaust gas opening and including, adjacent the upper end, a port, and being closed except for the port and for communication with the exhaust gas opening, and an exhaust gas discharge passageway having an upper end communicating with the port, communicating, at the lower end, with the discharge duct in the drive shaft housing, and being independent of the exhaust gas pulse passageway and including therein a catalytic element.

The invention also provides an engine comprising a catalytic element, a first member including first wall means including a first wall paritally defining an exhaust gas passage including a compartment housing the catalytic element, and a second member including second wall means including a second wall in opposing relation to the first wall and cooperating with the first wall means to further define the exhaust gas passage and the compartment, and means detachably fastening together the first and second members so that, when the first and second members are fastened together, the compartment is completed and so that, when the second member is detached from the first member, the catalytic element can be removed from the compartment and replaced with another catalytic element.

The invention also provides an engine comprising a catalytic element, an engine block including a cylinder having an exhaust port, and an exhaust gas passage communicating with the exhaust port, a first member including first wall means paritally defining an exhaust gas passage including a compartment housing the catalytic element, means fastening the first member to the engine block with the exhaust gas passage is the engine block in communication with the exhaust gas passage in the first member, a second member including second wall means cooperating with the first wall means to further define the exhaust gas passage including the compartment, and means detachably fastening together the first and second members so that, when the first and second members are fastened together, the first and second members engage the catalytic element to retain the catalytic element in the compartment and prevent relative movement between the catalytic element and the first and second members, and so that, when the second member is detached from the first member, the catalytic element is removable from the compartment.

Other features and advantages of the invention will become apparent to those skilled in the art upon review of the following detailed description, claims, and drawings.

THE DRAWINGS

Figure 2:
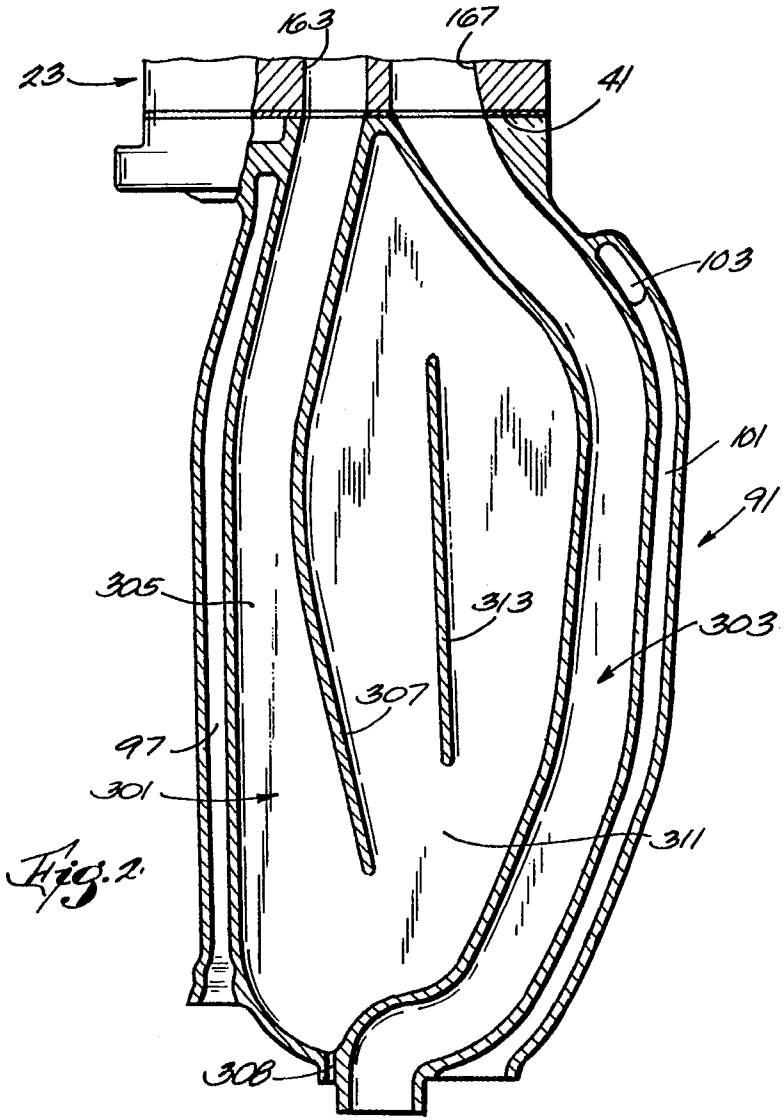
FIG. 2 is an enlarged sectional view of a portion of the outboard motor shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 1:
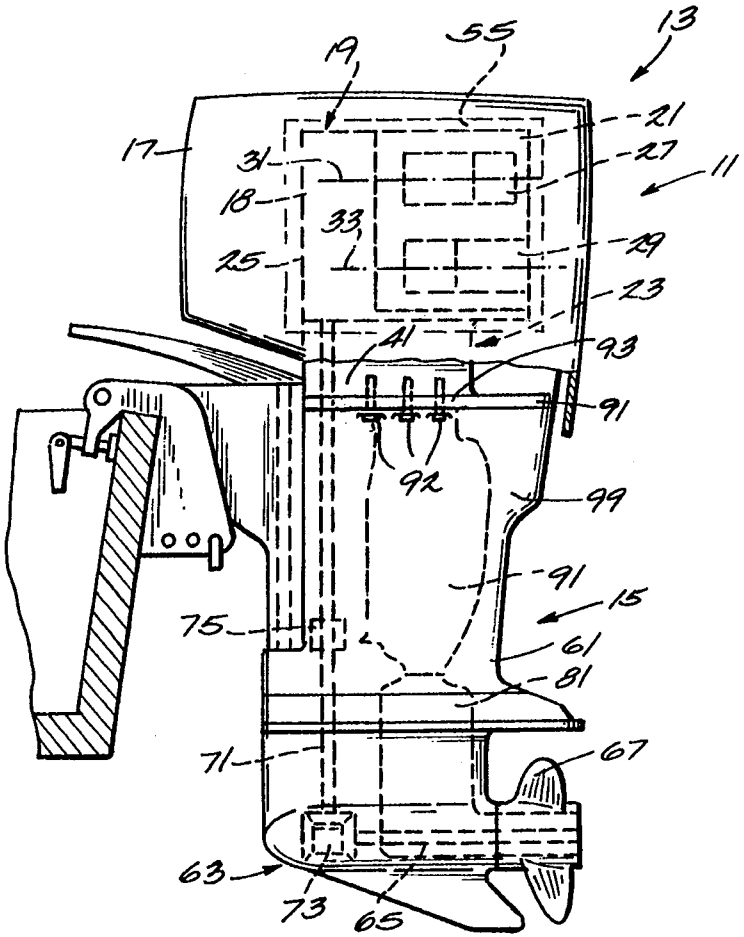
FIG. 1 is a side elevational view, partially broken away and in section, of an outboard motor incorporating various of the features of the invention.

Shown in FIG. 1 of the drawings is an outboard motor 11 including a power head 13 and a lower unit 15. The power head 13 comprises an engine cowling 17 and an internal combustion engine 18 including an engine block assembly 19 which includes (see FIG. 3) an engine block 21 and (see FIG. 4) a side member assembly 23. The engine block 21 includes a crankcase 25, a pair of upper and lower cylinders 27 and 29 extending from the crankcase 25, having (see FIG. 4) respective vertically aligned horizontal axes 31 and 33, and respectively including exhaust gas ports 35 and 37. The engine block 21 also includes a lower flat or planar surface 41 extending parallel to the cylinder axes 31 and 33 and a flat or planar side surface 43 extending perpendicularly to the flat lower surface 41.

Figure 4:
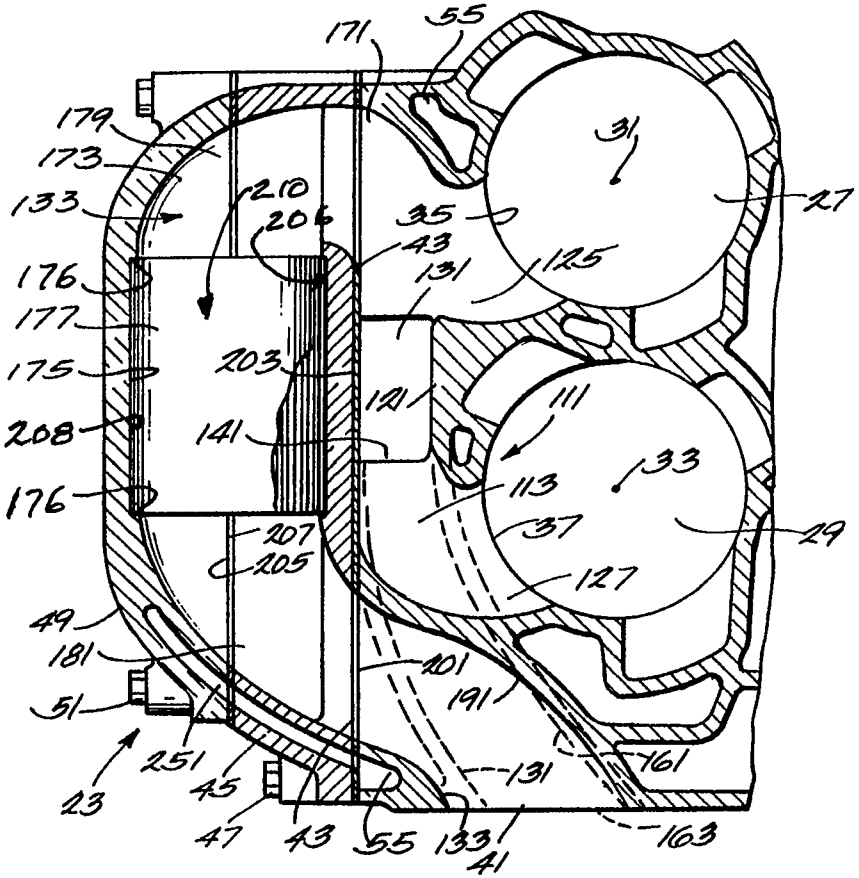
FIG. 4 is a sectional view taken along line 4—4 of FIG. 3.

As shown best in FIG. 4, the side member assembly 23 is fixed to the side surface 43 of the engine block 21 by suitable means and includes a first side member 45 fixed to and engaging the side surface 43 of the engine block 21 by suitable means, such as the bolts 47, and a second side member 49 fixed to and engaging the first side member 45 by suitable means, such as the bolts 51.

The engine block assembly 19 also includes (see FIG. 1) an engine coolant jacket 55 which extends into the side member assembly 23.

The lower unit 15 includes (see FIG. 1) a drive shaft housing 61 having an upper end fixed to the lower flat surface 41 of the engine block assembly 19 and a lower end fixed to a gear case 63 which rotatably supports a propeller shaft 65 carrying a propeller 67. The drive shaft housing 61 is generally hollow and includes a vertically extending drive shaft 71 which is driven by the engine 18 and which is connected to the propeller shaft 65 by a suitable reversing transmission 73 located in the gear case 63.

Supported within the drive shaft housing 61 and driven by the drive shaft 71 is a water pump 75 which communicates through a suitable conduit (not shown) with the water in which the outboard motor 11 operates.

The drive shaft housing 61 also includes an exhaust gas and coolant water discharge duct 81 which extends through the gear case 63 and, preferably, communicates through the hollow interior of the propeller 67 with the water in which the outboard motor 11 operates.

Also included in the drive shaft housing 61 is an exhaust gas housing 91 which, at its upper end, includes a flange 93 which is suitably fastened, as by bolts 92, to the lower surface 41 of the engine block assembly 19 and, preferably, between the lower surface 41 of the engine block assembly 19 and the drive shaft housing 61.

The exhaust housing 91 includes (see FIG. 2) a water supply passage 97 communicating between the water pump 75 and the engine coolant jacket 55. In addition, the drive shaft housing 61 and the exhaust gas housing 91 define therebetween (see FIG. 1) a drive shaft housing coolant jacket 99 which surrounds at least the lower part of the exhaust gas housing 91 and which communicates with the engine coolant jacket 55 to receive discharge coolant therefrom. In addition, the exhaust gas housing 91 includes (see FIG. 2) a drive shaft housing coolant jacket overflow passage 101 which, at its upper end, communicates through a port 103 with the drive shaft housing coolant jacket 99 and which, at its lower end, communicates with the discharge duct 81 in the drive shaft housing 61 and gear case 63.

The outboard motor 11 also includes an exhaust gas system 111 which independently affords tuning of the cylinders 27 and 29 and catalytic treatment of the exhaust gas being discharged. More particularly, in the engine block assembly 19, the exhaust gas system 111 includes a collector passage 113 which communicates with the exhaust ports 35 and 37 and which includes a main or central portion 114 which is defined, in part, by a vertically extending recess 115 formed in the side surface 43 by a pair of vertically and laterally extending walls 117 and 119 spaced from each other in the fore and aft direction and by a vertical wall 121 extending parallel to the side surface 43 and connected to the walls 117 and 119. The recess 115 is also defined by a lower or bottom wall 123 extending between and connecting the vertical walls 117, 119, and 121.

Figure 3:
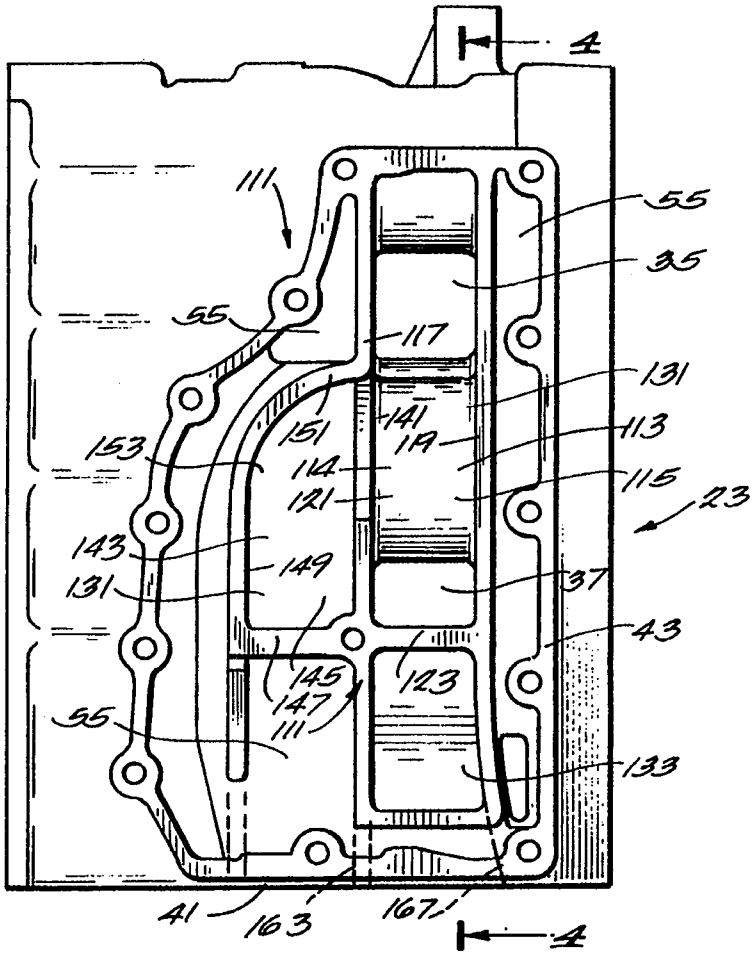
FIG. 3 is an elevational view of one side of the engine block included in the outboard motor shown in FIG. 1.

The collector passage 113 also includes (see FIG. 4) an upper and lower connecting portions 125 and 127 which communicate between the main or central portion 114 and the exhaust ports 35 and 37 of the upper and lower cylinders 27 and 29. Thus, as seen in FIG. 3, the collector passage 113 extends generally vertically, is open at the side surface 43, and is generally of rectangular shape.

Communicating with the collector passage 113 are (see FIG. 4) an exhaust gas pulse passage 131 which is associated with the tuning function and an exhaust gas discharge passage 133 which functions to afford the discharge of the exhaust gases. More particularly, the forwardly located wall 117 includes therein a port 141 which communicates with (see FIG. 3) a first portion 143 of the exhaust gas pulse passage 131. The portion 143 is formed by a recess 145 which opens into the side surface 43 and which is defined by a portion of the wall 117, by a horizontal and lateral extending bottom wall 147 which extends in fore and aft alignment with the bottom wall 123 at the side surface 43, by a wall 149 extending vertically and laterally in forwardly spaced relation to the wall 117, by a curving or arcuate wall 151 connecting the wall 149 and the upper edge of the port 141, and by an interior wall 153 spaced laterally inwardly of the side surface 43 and connected to the vertical walls 117 and 149, and the curving wall 151.

Figure 5:
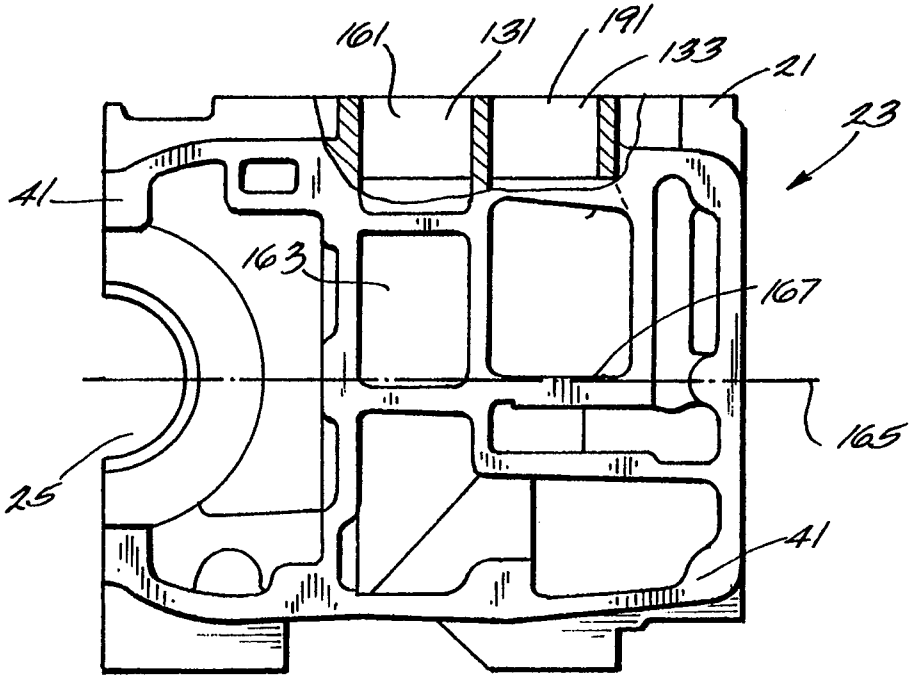
FIG. 5 is a partially broken away bottom view of the engine block shown in FIG. 3.

The exhaust gas pulse passage 113 also includes a second portion 161 which extends internally within the engine block 21 and in inclined relation to the side surface 43 and the lower surface 41 and from the first pulse passage portion 143 to a pulse passage opening 163 located in the lower surface 41 of the engine block 21 and (see FIG. 5) slightly to one side of a fore and aft center line 165. While other constructions can be employed, the pulse passage opening 163 and the passage portions 143 and 161 are generally of square or rectangular configuration.

The exhaust gas discharge passage 133 also communicates with the main portion 114 of the collector passage 113 and terminates in the lower surface 41 of the engine block 21 in an exhaust gas discharge opening 167 located in general fore and aft alignment with, and rearwardly of, the pulse passage opening 163. While the discharge passage opening 167 can be of various configurations, in the disclosed construction, it is generally of rectangular configuration.

The discharge passage 133 includes (see FIG. 4) a first portion 171 which communicates with the upper end of the collector passage 113 and which is open into the side surface 43, a second passage portion 173 formed in the side member assembly 23 and including an enlarged sub-portion 175 holding in place a suitable catalytic element 177 through which passes all of the exhaust gas to be discharged. Any suitable catalytic element 177 can be employed. Preferably, the catalytic element 177 is of the type which includes active portions located throughout the cross-sectional area of the enlarged sub-passage portion 175. Any suitable means can be employed for retaining the catalytic element 177 in proper position within the enlarged sub-portion 175. In the disclosed construction, the enlargement of the sub-portion 175 provides annular shoulders 176 which engage the ends of the catalytic element 171 to prevent movement thereof in the direction of flow of the exhaust gases.

The second passage portion 173 also includes an inlet sub-portion 179 communicating between the enlarged sub-portion 175 and the discharge passage portion 171 in the engine block 21. In addition, the discharge passage portion 173 includes an outlet sub-portion 181 which communicates with the enlarged sub-portion 175 and opens into the first side member face 201 engaged with the side surface 43.

In addition, the discharge passage 133 includes (see FIG. 3) a third portion 191 which extends internally in the engine block 21 between the side surfaces 43 and the lower surface 41, in inclined relation thereto, and in rearwardly spaced relation to the pulse passage 131 and which communicates between the outlet sub-portion 181 in the side member assembly 23 and the discharge passage opening 167 in the lower surface 41 of the engine block 21.

The first side member 45 includes a flat mounting face or surface which mates with the side surface 43 of the engine block 21 and which includes a portion 203 covering the recess 115 forming the main portion 114 of the collector passage 113 and the recess 145 forming the first portion 143 of the pulse passage 131. The first side member 45 is also formed to include a second mounting surface 205 generally parallel to the surfaces 201 and 43 and to include a semi-circular wall 206 which opens into the second mounting surface 205, defines one half of the enlarged sub-portion 175 of the pulse passage portion 173 in the side member assembly 23 and which engages the catalytic element 177 to retain the catalytic element 171 in place.

The second side member 49 is formed with a mounting surface 207 engaging the second mounting surface 205 of the first side member 45 and includes a semicylindrical wall defining the other half of the enlarged sub-portion 175 of the pulse passage portion 173 in the side member assembly 23, and which is located in opposing relation to the cooperating wall 206 of the first side member 45. Together the opposing walls 206 and 208 and the shoulders 176 form a compartment 210 holding in place the catalytic element 171.

Removal of the second side member 49 from the first side member 45 permits removal of the catalytic element and replacement with another catalytic element.

Suitable coolant passages or Jackets 251 communicating with the engine coolant jacket 55 are provided adjacent the exterior surfaces of the side member assembly 23. If desired, the jackets 251 can terminate in spaced relation to the external surface of the side member assembly 23 in the area of the catalytic element 177, and a suitable insulating member (not shown) can be provided between catalytic element 177 and the adjacent exterior surface of the side member assembly 23 to retain heat in the catalytic element 177 and to diminish heat transfer to the exterior surface of the side member assembly 23 adjacent to the catalytic element 177.

The exhaust gas system 111 also includes, in the lower unit 15 (see FIG. 2), an exhaust gas pulse passageway 301 formed in the exhaust housing 91 and communicating with the pulse passage opening 163 in the lower surface 41 of the engine block 21 and an exhaust gas discharge passageway 303 formed in the exhaust housing 91, and communicating with the discharge passage opening 167 in the lower surface 41 of the engine block 21. More particularly, the pulse passageway 301 extends to the upper end of the exhaust housing 91 and includes a downwardly extending first leg 305, defined, in part, by the outer surface of the exhaust housing 91 and by an inner partition or wall 307. At the lower end of the first leg 305, the pulse passageway 301 is closed, except for a small or restricted moisture drain hole 308 which does not detrimentally affect the pulsing operation and except for communication with an upwardly extending second leg 311 which is closed at its upper end.

A strengthening partition or wall 313 extending laterally and vertically within the exhaust housing 91 and bisecting a portion of the second leg 311 can be employed to increase the strength or rigidity of the exhaust housing 91. The lengths and cross sectional dimensions of the first and second legs 305 and 311 can be varied as desired to achieve the desired tuning of the upper and lower cylinders 27 and 29.

The exhaust gas discharge passageway 303 extends downwardly from the upper end of the exhaust housing 91 wherein the discharge passageway 303 communicates with the discharge passage opening 167 in the lower surface 41 of the engine block 21. The exhaust gas discharge passageway 303 extends in rearward relation to pulse passageway 301 and, at its lower end, discharges into the discharge duct 81 in the drive shaft housing 61 and gear case 63.

The before mentioned water supply passage 97 is located in the exhaust housing 91 forwardly of the pulse passageway 301 and the before mentioned overflow passage 101 is located in the exhaust housing 91 rearwardly of the discharge passageway 303.

Because the tuning function of the exhaust gas system 111, performed by the pulse passage 131 and the pulse passageway 301, is separate from the exhaust gas discharging function provided by the discharge passage 133 and the discharge passageway 303, the pulsing acoustical pressure waves are not attenuated due to passage through the catalytic element 177. In addition, because the exhaust gas discharging function and the tuning function are separated in the engine block 21, and remain separate in the exhaust housing 91, the location of the catalytic element 177 in the engine block assembly 19 is sufficiently high to minimize the possibility of contact with the water in which the outboard motor 11 operates.

Figure 6:
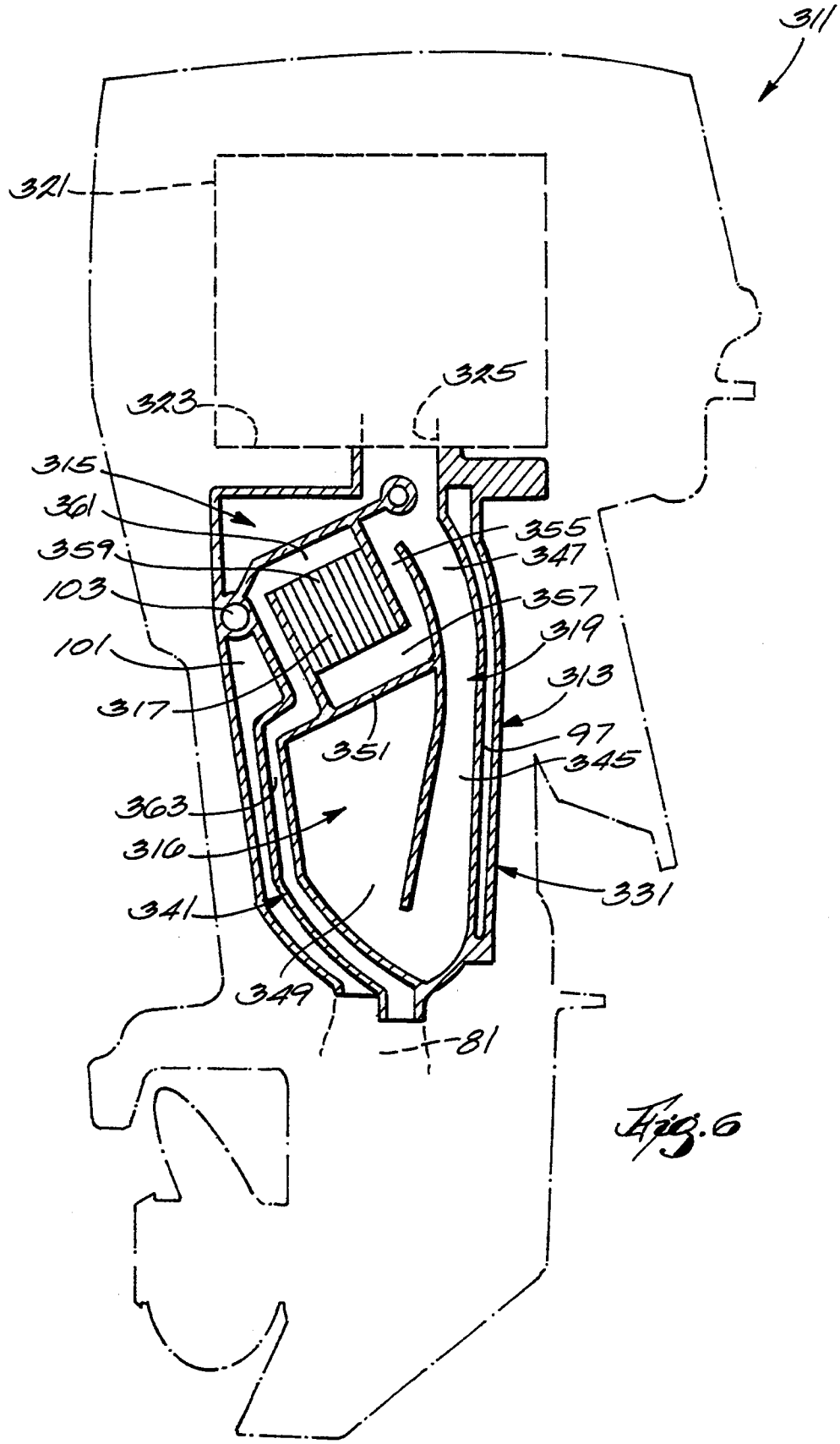
FIG. 6 is a partially schematic view of a second embodiment of an outboard motor incorporating various of the features of the invention.

Shown in FIG. 6 is another embodiment of an outboard motor 311 in which exhaust gases are discharged through an exhaust passageway system 313 including a catalytic element 315 and in which a closed pulse passageway 317 is provided.

In the embodiment shown in FIG. 6, the outboard motor 311 includes a powerhead 321 having a lower surface 323 with a single exhaust gas port or opening 325 which communicates with the two exhaust ports previously mentioned.

The outboard motor 311 also includes an exhaust housing 331 including the closed pulse passageway 317 which directly communicates with the exhaust discharge opening 325 in the lower surface 323 of the powerhead 321 and which, adjacent the upper end thereof, communicates through an outlet 333 with one end of an exhaust discharge passageway 341 which, in turn, at its other end, communicates with a discharge duct, such as the duct 81, which in turn, communicates with an underwater discharge.

The closed exhaust pulse passageway 317 includes a first downwardly extending leg 345 which, at its upper end, includes an upper portion 347 communicating with the exhaust discharge opening 325 and which, at its lower end, communicates with a second leg 349 which extends upwardly and, at its upper end, is closed by a top wall 351.

The exhaust discharge passageway 341 includes, in series, a first portion 355 extending downwardly and forwardly along the rear wall of the upper portion 347 of the first leg 345 of the closed pulse passageway 317, a second inclined portion 357 extending from the lower end of the first portion 355 and downwardly and rearwardly along the top wall 351 of the second leg 349 of the closed pulse passageway 317, a third portion 359 which extends upwardly from the lower end of the second portion 357, which is enlarged as compared to the first and second portions 355 and 347, and which contains the catalytic element 315, a fourth portion 361 which extends across the top of the catalytic element 315 and which communicates, at its rearward end, with a fifth portion 363 extending downwardly along the rear wall of the second leg 349 of the closed pulse passageway 317 and communicating, at its lower end, with a duct in the lower unit, such as the before mentioned duct 81.

As in the embodiment shown in FIGS. 1 and 2, the exhaust housing 331 also includes a water jacket drain or overflow passage 101 and a water inlet supply passage or duct 97.

In the embodiment shown in FIG. 6, because the exhaust gases are not discharge through the closed pulse passageway 317, the exhaust gases therein are relatively cool as compared to the exhaust gases in the discharge passageway 341 and, accordingly, as in the embodiment of FIGS. 1 through 5, the length of the second leg 349 can be shortened without adversely affecting the tuning of the engine. Such shortening permits location of the catalytic element 315 above the top of the second leg 349 of the pulse passageway 317 at a relatively high point in the exhaust housing 331, thereby effectively avoiding the possibility contact with water. In addition, it is noted that the discharge from the catalytic element 315 is at the top, which means that any water within the exhaust housing 331 would have to extend almost to the top thereof in order to enter into the catalytic element 315. Thus the embodiment shown in FIG. 6 provides similar advantages to the embodiment shown in FIGS. 1 through 5 and also provides a very compact arrangement. However, in the embodiment of FIG. 6 the catalytic element 315 is replaceable only after disassembly of the exhaust housing 331 from the power head 321. Thus, the FIG. 6 embodiment does not afford the ease of catalytic element replacement which is provided in the embodiment of FIGS. 1 through 5.

Various of the features of the invention are set forth in the following claims.

We claim:

1. An outboard motor comprising an engine block including a lower surface having therein first and second exhaust gas openings, a drive shaft housing fixed to said lower surface of said engine block and including a discharge duct terminating in an underwater discharge opening, and an exhaust gas housing located in said drive shaft housing and including an upper end fixed to said lower surface of said engine block, a lower end, an exhaust gas pulse passageway communicating, at said upper end, with said first exhaust gas opening and being closed except for communication with said first exhaust gas opening, and an exhaust gas discharge passageway communicating, at said upper end, with said second exhaust gas opening, communicating, at said lower end, with said discharge duct in said drive shaft housing, and being independent of said exhaust gas pulse passageway within said exhaust gas housing.

2. An outboard motor in accordance with claim 1 wherein said engine block includes upper and lower cylinders having respective axes parallel to said lower surface and including respective exhaust ports, an exhaust gas collector passage communicating with said exhaust ports, an exhaust gas pulse passage communicating between said collector passage and said first exhaust gas opening, and an exhaust gas discharge passage communicating between said collector passage and said second exhaust gas opening and including a portion containing a catalytic converter.

3. An outboard motor in accordance with claim 2 wherein said engine block is one part of an engine block assembly and includes a side surface extending transversely to said lower surface, and wherein said engine block assembly also includes a side member assembly including a first side member mounted on said side surface, and partially defining said portion of said exhaust gas discharge passage, and a second side member mounted on said first side member and partially defining said portion of said exhaust gas discharge passage.

4. An outboard motor in accordance with claim 1 wherein said engine block includes an engine block coolant jacket, wherein said drive shaft housing includes a water pump, and a discharge passage, wherein said drive shaft housing and said exhaust gas housing define therebetween a drive shaft housing coolant jacket communicating with said engine coolant jacket, and wherein said exhaust gas housing also includes a water supply passage communicating between said water pump and said engine coolant jacket, and a coolant jacket overflow passage communicating with said drive shaft housing coolant jacket and with said discharge passage in said drive shaft housing.

5. An engine block assembly including a flat surface having therein first and second exhaust gas openings, a crankcase, first and second cylinders extending from said crankcase and respectively including first and second exhaust gas ports, and an exhaust gas passage system communicating with said exhaust gas ports and including an exhaust gas pulse passage terminating in said first exhaust gas opening, and an exhaust gas discharge passage terminating in said second exhaust gas opening and including a portion extending generally perpendicularly to said flat surface so as to afford gas flow therein in the direction perpendicular to said flat surface, said discharge passage portion containing therein a catalytic element.

6. An engine block assembly in accordance with claim 5 wherein said exhaust gas passage system also includes a collector passage communicating with said exhaust gas ports and with said exhaust gas pulse passage and with said exhaust gas discharge passage.

7. An engine block assembly in accordance with claim 6 wherein said engine block assembly comprises an engine block including said flat surface and a second surface extending transversely to said flat surface, wherein said collector passage is defined in part by a recess in said second surface, wherein said exhaust gas pulse passage includes therein a first portion communicating with said collector passage and defined, in part, by a recess in said second surface, and a second portion communicating between said first portion and said first exhaust gas opening and extending interiorly within said engine block, and wherein said engine block assembly also comprises a side member assembly including a first side member mounted on said second surface, partially defining said portion of said exhaust gas discharge passage containing said catalytic element, closing said recess defining said collector passage, and closing said recess defining said first portion of said exhaust gas pulse passage, and a second side member mounted on said first side member and partially defining said portion of said exhaust gas discharge passage containing said catalytic element.

8. An engine block assembly in accordance with claim 7 wherein said exhaust gas discharge passage also includes a first engine block portion defined by a recess in said second surface and communicating between said collector passage and said portion containing said catalytic element, and a second engine block portion extending internally within said engine block and communicating between said portion containing said catalytic element and said second exhaust gas opening, and wherein said portion containing said catalytic element is located in said side assembly.

9. An outboard motor comprising an engine block assembly including a lower surface having therein first and second exhaust gas openings, a crankcase, upper and lower cylinders extending from said crankcase and respectively including first and second exhaust gas ports, and an exhaust gas passage system including a collector passage communicating with said exhaust gas ports, an exhaust gas pulse passage communicating between said collector passage and said first exhaust gas opening, and an exhaust gas discharge passage communicating between said collector passage and said second exhaust gas opening and including a portion containing a catalytic element, a drive shaft housing fixed to said lower surface of said engine block assembly and including a discharge duct terminating in an underwater discharge opening, and an exhaust gas housing located in said drive shaft housing and including an upper end fixed to said lower surface of said engine block assembly, a lower end, an exhaust gas pulse passageway communicating, at said upper end, with said first exhaust gas opening and being closed except for communication with said first exhaust gas opening, and an exhaust gas discharge passageway communicating, at said upper end, with said second exhaust gas opening, communicating, at said lower end, with said discharge duct in said drive shaft housing, and being independent of said exhaust gas pulse passageway within said exhaust gas housing.

10. An outboard motor in accordance with claim 9 wherein said engine block assembly includes an engine coolant jacket, wherein said drive shaft housing includes a water pump, wherein said drive shaft housing and said exhaust gas housing define therebetween a drive shaft housing coolant jacket communicating with said engine coolant jacket, and wherein said exhaust gas housing also includes a water supply passage communicating between said water pump and said engine coolant jacket, and a coolant jacket overflow passage communicating with said drive shaft housing coolant jacket and with said discharge duct in said drive shaft housing.

11. An outboard motor in accordance with claim 9 wherein said engine block assembly comprises an engine block including said lower surface and a side surface extending transversely to said lower surface, wherein said collector passage is defined in part by a recess in said side surface, wherein said exhaust gas pulse passage includes therein a first portion communicating with said collector passage and defined, in part, by a recess in said side surface, and a second portion communicating between said first portion and said first exhaust gas opening and extending interiorly within said engine block, and wherein said engine block assembly also comprises a side member assembly including a first side member mounted on said side surface, partially defining said portion of said exhaust gas discharge passage containing said catalytic element, closing said recess defining said collector passage, and closing said recess defining said first portion of said exhaust gas pulse passage, and a second side member mounted on said first side member and partially defining said portion of said exhaust gas discharge passage containing said catalytic element.

12. An outboard motor in accordance with claim 11 wherein said exhaust gas discharge passage includes a first engine block portion defined by a recess in said side surface and communicating between said collector passage and said portion containing said catalytic element, and a second engine block portion extending internally within said engine block and communicating between said portion containing said catalytic element and said second exhaust gas opening, and wherein said portion containing said catalytic element is located in said side assembly.

13. An outboard motor comprising an engine block including a lower surface having therein an exhaust gas opening, a drive shaft housing fixed to said lower surface of said engine block and including a discharge duct terminating in an underwater discharge opening, and an exhaust gas housing located in said drive shaft housing and including an upper end fixed to said lower surface of said engine block, a lower end, an exhaust gas discharge passageway communicating, at said upper end, with said exhaust gas opening, communicating, at said lower end, with said discharge duct in said drive shaft housing, and including therein a catalytic element, and an exhaust gas pulse passageway communicating, at said upper end, with said exhaust gas opening, being closed except for communication with said exhaust gas opening and, at said upper end, with said exhaust gas discharge passage upstream of said catalytic element.

14. An outboard motor in accordance with claim 13 wherein said engine block includes upper and lower cylinders having respective axes parallel to said lower surface and including respective exhaust ports, and an exhaust gas collector passage communicating between said exhaust ports and said exhaust gas opening.

15. An outboard motor in accordance with claim 13 wherein said engine block includes an engine block coolant jacket, wherein said drive shaft housing includes a water pump, and a discharge passage, wherein said drive shaft housing and said exhaust gas housing define therebetween a drive shaft housing coolant jacket communicating with said engine coolant jacket, and wherein said exhaust gas housing also includes a water supply passage communicating between said water pump and said engine coolant jacket, and a coolant jacket overflow passage communicating with said drive shaft housing coolant jacket and with said discharge passage in said drive shaft housing.

16. An outboard motor in accordance with claim 15 wherein said exhaust gas pulse passage includes a first leg extending downwardly from said upper end and having a lower end, and a second leg extending upwardly from said lower end of said first leg and including a top end wall and a rear wall, and wherein said exhaust gas discharge passageway includes a first portion located above said top wall and including therein said catalytic element, a supply portion communicating between said exhaust gas opening and said first portion and extending along said top wall, and a discharge portion communicating with said first portion and extending along said rear wall.

17. An outboard motor comprising an engine block including a lower surface having therein an exhaust gas opening, a crankcase, upper and lower cylinders extending from said crankcase and respectively including first and second exhaust gas ports, and an exhaust gas passage system including a collector passage communicating between said exhaust gas ports and said opening, and a drive shaft housing fixed to said lower surface of said engine block and including a discharge duct terminating in an underwater discharge opening, and an exhaust gas housing located in said drive shaft housing and including an upper end fixed to said lower surface of said engine block, a lower end, an exhaust gas pulse passageway communicating, at said upper end, with said exhaust gas opening and including, adjacent said upper end, a port, and being closed except for said port and for communication with said exhaust gas opening, and an exhaust gas discharge passageway having an upper end communicating with said port, communicating, at said lower end, with said discharge duct in said drive shaft housing, and being independent of said exhaust gas pulse passageway and including therein a catalytic element.

18. An outboard motor in accordance with claim 17 wherein said exhaust gas pulse passage includes a first leg extending downwardly from said upper end and having a lower end, and a leg extending upwardly from said lower end of said first leg and including a top end wall and a rear wall, and wherein said exhaust gas discharge passageway includes a first portion located above said top wall and including therein said catalytic element, a supply portion communicating between said exhaust gas opening and said first portion and extending along said top wall, and a discharge portion communicating with said first portion and extending along said rear wall.

19. An outboard motor in accordance with claim 17 wherein said engine block assembly includes an engine coolant jacket, wherein said drive shaft housing includes a water pump, wherein said drive shaft housing and said exhaust gas housing define therebetween a drive shaft housing coolant jacket communicating with said engine coolant jacket, and wherein said exhaust gas housing also includes a water supply passage communicating between said water pump and said engine coolant jacket, and a coolant jacket overflow passage communicating with said drive shaft housing coolant jacket and with said discharge duct in said drive shaft housing.

20. An engine comprising a catalytic element, a first member including first wall means including a first wall paritally defining an exhaust gas passage extending in a given direction and including a first recess extending along said direction and partially defining a compartment housing said catalytic element, and a second member including second wall means including a second wall in opposing facing relation to said first wall and cooperating with said first wall to further define said exhaust gas passage and including a second recess extending along said direction and located in opposing facing relation to said first recess and cooperating with said first recess to further define said compartment, and means detachably fastening together said first and second members so that, when said first and second members are fastened together, said compartment is completed and so that, when said second member is detached from said first member, said catalytic element can be removed from said compartment and replaced with another catalytic element.

21. An engine in accordance with claim 20 wherein said exhaust passage includes an inlet portion, an outlet portion, and an intermediate portion which is located between said inlet and outlet portions, and which includes said compartment and means for preventing movement of said catalytic element in the direction of said passage.

22. An engine in accordance with claim 21 wherein said means for preventing movement of said catalytic element includes engagement of said catalytic element by shoulders formed in said passage consequent to enlargement of said intermediate portion as compared to said inlet and outlet portions.

23. An engine comprising a catalytic element, an engine block including a cylinder having an exhaust port, and an exhaust gas passage communicating with said exhaust port, a first member including first wall means partially defining an exhaust gas passage extending in a given direction and including a first recess extending along said direction and partially defining a compartment housing said catalytic element, means fastening said first member to said engine block with said exhaust gas passage in said engine block in communication with said exhaust gas passage in said first member, a second member including second wall means cooperating with said first wall means to further define said exhaust gas passage and including a second recess extending along said direction in opposing facing relation to said first recess and further partially defining said compartment, and means detachably fastening together said first and second members so that, when said first and second members are fastened together, said first and second members engage said catalytic element to retain said catalytic element in said compartment and prevent relative movement between said catalytic element and said first and second members, and so that, when said second member is detached from said first member, said catalytic element is removable from said compartment.

* * * * *

UNITED STATES PATENT AND TRADEMARK OFFICE

CERTIFICATE OF CORRECTION

PATENT NO. : 5,372,530

DATED : December 13, 1994

INVENTOR(S) : Holtermann, et al.

It is certified that error appears in the above—identified patent and that said Letters Patent is hereby corrected as shown below:

On the cover page, add the following:

Assignee: OUTBOARD MARINE CORPORATION
Waukegan, Illinois

Signed and Sealed this

Eighteenth Day of July, 1995

Bruce Lehman

*Attest:*

BRUCE LEHMAN

*Attesting Officer*

*Commissioner of Patents and Trademarks*